US006825741B2

(12) United States Patent
Chappell et al.

(10) Patent No.: US 6,825,741 B2
(45) Date of Patent: Nov. 30, 2004

(54) PLANAR FILTERS HAVING PERIODIC ELECTROMAGNETIC BANDGAP SUBSTRATES

(75) Inventors: William Johnson Chappell, Lafayette, IN (US); Linda P. B. Katehi, Zionsville, IN (US); Matthew Patrick Little, Natick, MA (US)

(73) Assignee: The Regents of the University Michigan, Ann Arbor, MI (US)

( * ) Notice: Subject to any disclaimer, the term of this patent is extended or adjusted under 35 U.S.C. 154(b) by 0 days.

(21) Appl. No.: 10/171,300

(22) Filed: Jun. 12, 2002

(65) Prior Publication Data

US 2003/0020567 A1 Jan. 30, 2003

Related U.S. Application Data

(60) Provisional application No. 60/297,526, filed on Jun. 13, 2001.

(51) Int. Cl.[7] ..... H01P 1/20
(52) U.S. Cl. ..... 333/204; 333/202; 333/219
(58) Field of Search ..... 333/202, 204, 333/219

(56) References Cited

U.S. PATENT DOCUMENTS

| | | | | | |
|---|---|---|---|---|---|
| 5,471,180 | A | * | 11/1995 | Brommer et al. | 333/202 |
| 5,748,057 | A | * | 5/1998 | De Los Santos | 333/134 |
| 5,784,400 | A | * | 7/1998 | Joannopoulos et al. | 372/96 |
| 5,818,309 | A | * | 10/1998 | De Los Santos | 333/176 |
| 6,130,969 | A | * | 10/2000 | Villeneuve et al. | 385/27 |
| 6,640,034 | B1 | * | 10/2003 | Charlton et al. | 385/122 |
| 2002/0159733 | A1 | * | 10/2002 | Flory et al. | 385/125 |

OTHER PUBLICATIONS

Lee et al., "Diople and tripole metallodielectric photonic bandgap (MPBG) structures for microwave filter and antenna applications", IEE Proc.–Optoelectron., vol. 147, NO. 6, Dec. 2000, pp. 395–400.*

Ali E. Atia and Albert E. Williams; Narrow–Bandpass Waveguide Filters, Jul. 16, 1971, 8 pages, Comsat Laboratories, Clarksburg, MD 20734.

Meade, Devenyi, et al.; Novel applications of photonic band gap materials: Low–loss bends and high Q cavities; Jan. 6, 1994, 3 pages, American Institute of Physics.

Fei–Ran Yang, *Student Member, IEEE*, Kuang–Ping Ma, Yongxi Qian, *Member, IEEE*, and Tatsuo Itoh, *Life Fellow, IEEE; A Uniplanar Compact Photonic–Bandgap (UC–PBG) Structure and Its Applications for Microwave Circuits*; IEEE Transactions on Microwave Theory and Techniques, vo. 47, No. 8, Aug. 1999.

Michael J. Hill, Richard W. Ziolkowski, and John Papapolymerou,; *Simulated and Measured Results from a Duroid–Based Planar MBG Caity Resonator Filter*; IEEE Microwave and Guided Wave Letters, vol. 10 NO. 12, Dec. 2000.

William J. Chappell, Matthew P. Little, and P.B. Katehi, Radiation Laboratory, Department of Electrical Engineering and Computer Science, University of Michigan, 1301 Beal Avenue, Ann Arbor, MI 48109–2122; High Q Two Dimensional Defect Resonators—Measured and Simulated.

* cited by examiner

*Primary Examiner*—Benny Lee
*Assistant Examiner*—Kimberly E Glenn
(74) *Attorney, Agent, or Firm*—Young & Basile, P.C.

(57) ABSTRACT

The concept of electromagnetic bandgaps (EBG) is used to develop a high quality filter that can be integrated monolithically with other components due to a reduced height, planar design. Coupling adjacent defect elements in a periodic lattice creates a filter characterized by ease of fabrication, high-Q performance, high port isolation and integrability to planar or 3-D circuit architectures. The filter proof of concept has been demonstrated in a metallodielectric lattice. The measured and simulated results of 2-, 3- and 6-pole filters are presented at 10.7 GHz, along with the equivalent circuits.

30 Claims, 4 Drawing Sheets

PLANAR FILTERS HAVING PERIODIC ELECTROMAGNETIC BANDGAP SUBSTRATES

RELATED APPLICATIONS

This application claims the benefit of provisional application No. 60/297,526, which was filed on Jun. 13, 2001.

STATEMENT REGARDING FEDERALLY SPONSORED RESEARCH OR DEVELOPMENT

The US Government may have a paid-up license in this invention and the right in limited circumstances to require the patent owner to license others on reasonable terms as provided for by the contract No. DAAH04-96-1-0377 by Low-Power Electronics, MURI.

FIELD OF THE INVENTION

The present invention relates to planar filters having periodic electromagnetic bandgap (EBG) substrates.

BACKGROUND OF THE INVENTION

An EBG substrate, which is coated with metal on both sides creating a parallel plate, is either periodically loaded with metal or dielectric rods. For metallic inclusions, the substrate is loaded with metallic rods, effectively creating a high pass, two-dimensional filter that blocks energy from propagating in the substrate from DC to an upper cutoff. This form of arrangement is termed a metallo-dielectric EBG (also termed Photonic Bandgap or PBG). For dielectric inclusions, a two-dimensional band stop effect is created within the periodic material. This form of periodic substrate is termed a two-dimensional dielectric EBG.

An EBG defect resonator is made by intentionally interrupting the otherwise periodic lattice. The defect localizes energy within the lattice, and a resonance is created. A single defect resonator has been shown to provide high Qs, which make this resonator a good candidate for a sharp bandwidth, low insertion loss filter.

Using the concept of a constant coupling coefficient filter, a defect resonator is used to develop multipole filters. These filters exhibit excellent insertion loss and isolation due to the high Q exhibited by the Electromagnetic Bandgap (EBG) defect resonators. The fabrication of these filters requires nothing more than simple via apertures on a single substrate plane. In addition, the planar nature of these filters makes the filters amenable to 3-D circuit applications. Finally, since the EBG substrate prohibits substrate modes, the isolation between the input and output ports of the filter can be much greater than that of other planar architectures. Two, three, and six pole 2.7% filters were measured and simulated, with measured results showing insertion losses of −1.23, −1.55, and −3.28 dB, respectively. The out-of-band isolation was measured to be −32, −46, and −82 dB at 650 MHZ away from the center frequency (6% off center) for the three filters.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

The present invention focuses on the extension of a single metallo-dielectric resonator to multiple coupled defects. The coupled defects properly arranged create a multipole filter.

Figure 1A:
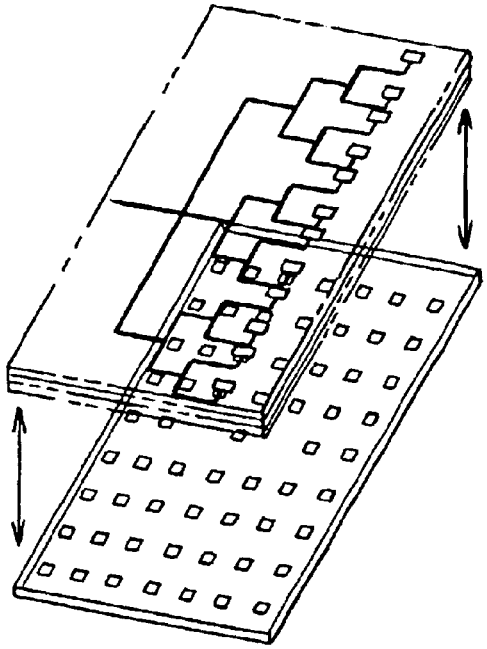
FIG. 1A is a composite view of a dimensional bonded circuit concept with 2-pole filtering substrate layer.
Figure 1B:
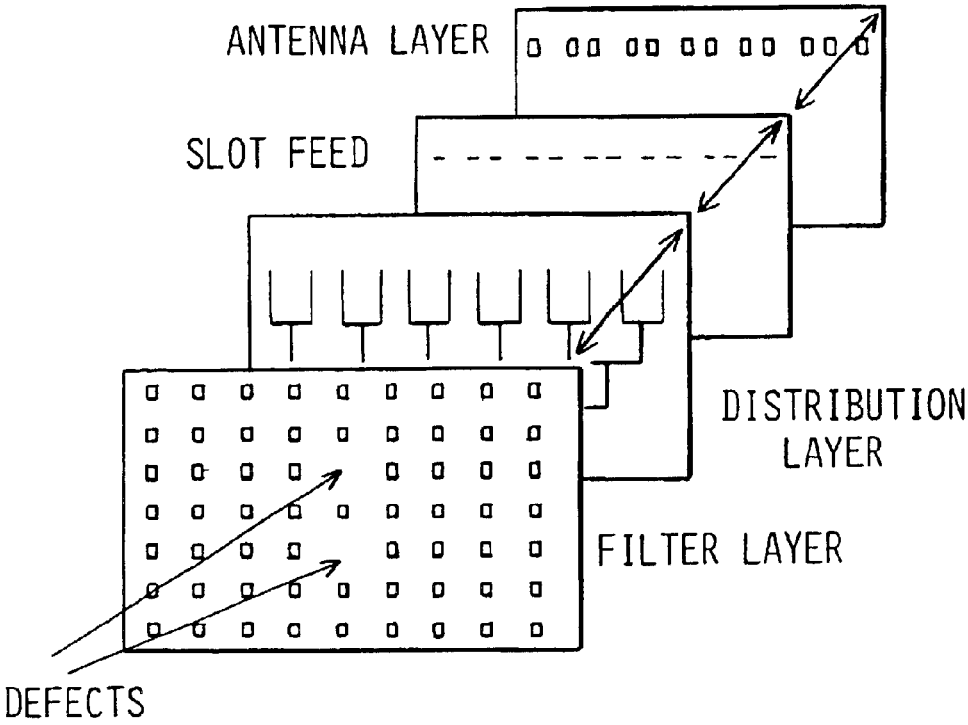
FIG. 1B is an exploded view of FIG. 1A.

As opposed to half-wave, microstrip or coplanar waveguide (CPW) resonators, the Q of the defect becomes larger, i.e. higher, with an electrically thicker substrate. FIG. 1A is a composite view of a dimensional bonded circuit concept showing a 2-pole filtering substrate layer 10. FIG. 1B is an exploded view of FIG. 1A showing, in addition to the filtering substrate layer 10, a distribution layer 12, a slot feed layer 14 and an anteturn layer 16. The EBG architecture is of significant practical relevance because the architecture produces a relatively high Q planer resonator by merely using via apertures in the substrate, which makes the filter amenable to planar fabrication techniques.

To fully exploit the defect resonators for the development of a multipole filter, an equivalent circuit is required. Using the Ansoft HFSS commercial simulator, a finite element method (FEM) simulation of two shorted CPW lines weakly coupled through a single resonator was used to determine the numerical values of the R, L, and C elements of the equivalent shunt resonator. From the peaked frequency response, the unloaded Q and the capacitance of the resonator can be determined. The unloaded Q is extracted by running a simulation with intentionally designed weak coupling and extracting the value from the magnitude of the transmission through the formula:

$$Q_{unloaded} = \frac{Q_{Loaded}}{(1 - S_{21})} = \frac{\left[\frac{f_0}{f_1 - f_2}\right]}{(1 - S_{21})} \tag{1.1}$$

where $f_1$ and $f_2$ are the frequencies at 3 dB below the peak resonant frequency transmission at $f_0$.

The capacitance is extracted by the phase of the weakly coupled reflection response through the following equation:

$$C = \frac{1}{2}\frac{dB}{d\omega}\bigg|_{\omega=\omega_0} \tag{1.2}$$

where B is the imaginary part of the admittance of the resonator deembedded to the end of the coupling line. With the unloaded Q and the capacitance, the rest of the shunt resonator parameters can be obtained using the classic formulas:

$$L = \frac{1}{\omega^2 C} \tag{1.3}$$

$$R = Q_{UNLOADED} * \omega * L \tag{1.4}$$

As a result, the parameters of the building block from which the rest of the filter is constructed can be obtained.

For a narrowband filter, the insertion loss for a given out-of-band isolation is optimal when the coupling between the resonators is constant. By implementing defect resonators adjacent to each other without otherwise perturbing that lattice, the coupling between the individual resonators will be constant for each stage and therefore optimal for insertion loss versus isolation. If desired, the coupling parameters may be adjusted, however, by slightly perturbing the lattice between the resonators, to achieve more complex filter shapes.

The fields within a single defect resonator evanesce into the surrounding periodic lattice and are not strictly localized within the defect region. When two defects are implemented adjacent to each other (as shown in) FIGS. 1A, 1B, 2A and 2B, the fields in the defects couple. As the defects couple to each other, the central frequency peak of the single resonator separates into two distinct peaks as shown in FIG. 2C. The amount that the peaks veer from the natural resonant frequency is a measure of the coupling coefficient. Therefore, FIG. 2C shows a graphical means to obtain the coupling coefficient between resonators. In order to discern distinct peaks in the transmission response, weak coupling to the defects is simulated. The coupling coefficient (k) can then be obtained, which can be related to the low-pass prototype values, by the following relations $$k = \frac{f_1^2 - f_2^2}{f_1^2 + f_2^2} = \frac{BW}{\omega}\sqrt{\frac{1}{G_j G_{j+1}}} \tag{1.5}$$

where $f_1$ and $f_2$ are the frequencies of the peaks in $S_{21}$, while $G_j$, $\omega$, and BW are the low pass element value, the low pass equivalent cutoff and filter bandwidth, respectively.

The location of a defect 20 in relation to the evanescent fields from an adjacent defect resonator 20 determines the coupling. The more lattice elements 22 that separate the defects from each other, the weaker the coupling. In addition, the sharper that the fields evanesce outside of each resonator, the less the coupling is for a given resonator separation. The shape, size, and period of the periodic inclusions, or lattice elements, 22 control the amount of confinement, of the resonant fields and, as a result, control the coupling. The coupling is decreased by designing the resonant frequency deeper within the bandgap region (i.e., a resonant frequency with sharper field attenuation into the surrounding lattice) and by increasing the separation between the resonators.

The sidewalls 24 of the metallo-dielectric resonator may be interpreted as a high pass two-dimensional spatial filter with many periodic short evanescent sections 26. The rejection of the high pass filter created by the evanescent sections defines the confinement of the fields and, therefore, the coupling between adjacent resonators 20. This rejection is determined by the spacing between the rods that make up the short evanescent sections. The further apart the metal surfaces of the vias that define the sidewalls of the resonators are from each other, the less the field surrounding the defect region evanesces. Therefore, by decreasing the size of the radius of the rod or by increasing the lattice period, the coupling increases. The fields inside resonators made from rods large in size relative to the lattice period are very tightly confined to the resonator.

In the equivalent circuit of the present filter, the shunt resonators that represent the defect are separated by a traditional J-inverter. This J-inverter controls the coupling between the shunt resonators and is therefore representative of the sidewalls that surround the defect. To determine the numerical values of the equivalent circuit for the J-inverter, a tee junction of three inductors is assumed. A circuit optimizer was used to determine the numerical values of the coupling inductances by matching the peak separation found from the full wave simulation of two weakly coupled resonators.

In addition, the external coupling must be determined and controlled. The external coupling ($Q_e$) controls the overall insertion loss and ripple in a multipole filter. The desired external coupling for the given coupled resonators is given as:

$$Q_e = \frac{G_0 G_{1\omega}}{BW} = \frac{\omega}{BW} \tag{1.6}$$

where the variables are the same as defined in previous sections. This external coupling can be extracted using simulated values of a single defect resonator. The coupling mechanism may be altered, resulting in a changed loaded Q of the system. Since the unloaded Q of the resonator has already been obtained for a single resonator, the external Q can be extracted from the relation:

$$\frac{1}{Q_l} = \frac{1}{Q_u} + \frac{1}{Q_e} \tag{1.7}$$

where $Q_l$ is the loaded Q and $Q_u$ is the unloaded Q. A simulation on a single resonator provides the 3 dB width for a given coupling scheme and therefore extracts the loaded Q value, which in turn determines the external Q.

Figure 2A:
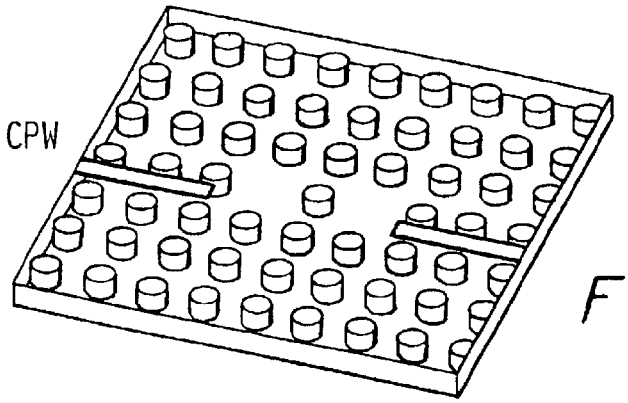
FIG. 2A is a two-pole simulation and electric field plot of coupled defects whose S-parameters indicate the interresonator coupling.
Figure 2B:
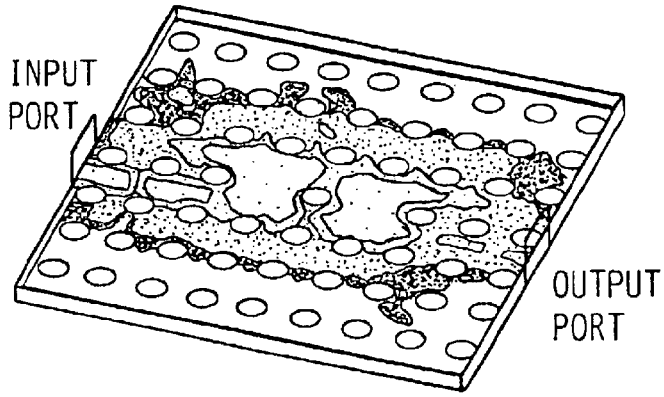
FIG. 2B is a schematic representation of two defects adjacent to one another used to generate the graph of FIG. 2A.
Figure 2C:
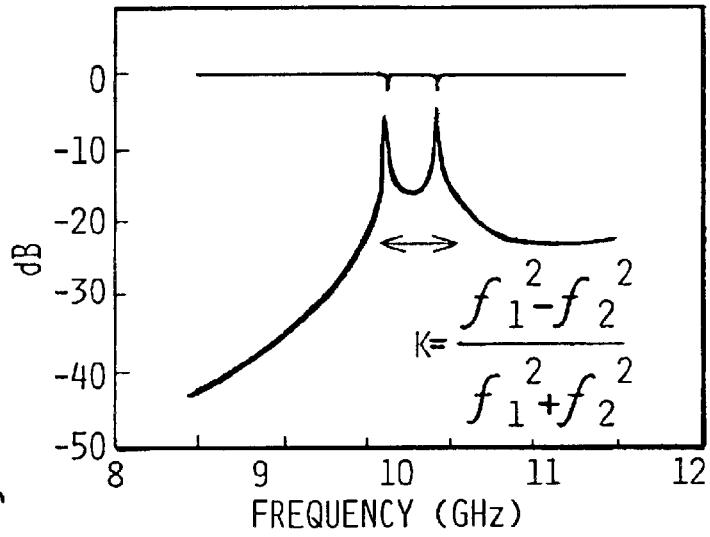
FIG. 2C is a graphic representation of the electric field generated with respect to FIGS. 2A and 2B.

For the metallo-dielectric filter described herein, a CPW line is used to provide the necessary external coupling as shown in FIGS. 2A and 2B. The CPW line is fed through the metallic lattice, probing into the defect cavity. The further the CPW line probes into the cavity of FIG. 2A, the lower the value of the external Q. If the external Q is too high, then distinct peaks are observed as large ripples in the transmission response. For this undercoupled case, the CPW line should be moved further into the cavity to lower the external Q. The equivalent circuit for the external coupling portion of the filter is a traditional impedance transformer. The turns ratio of the transformer is determined by the strength of the coupling to the first defect, and therefore is determined by the distance the CPW line impinges into the defect region, or cavity. The impedance transformer may be quantified by considering the simulation of a single resonator and is inherently related to the external Q.

Using the concepts described above, a prototype filter was developed out of Duroid 5880, $\epsilon_r$=2.2, loss tan=0.0009. The filter was chosen to have a center frequency at 10.7 GHz with approximately a 2.7 percent bandwidth. A single pole simulation, which takes less than an hour on a standard 400 MHZ Pentium III computer, was run using Ansoft HFSS, to determine the center frequency. Using a two-pole simulation (~1 hour run time), the diameter of the rods and the lattice period were adjusted to provide the correct coupling coefficients to provide the desired 2.7% bandwidth. Then, the length of the CPW line was adjusted to critically couple the filter to provide minimum insertion loss.

The resulting lattice has a transverse period of 9 mm, longitudinal period of 7 mm, and rod radius of 2 mm. For a substrate height of 120 mils, the unloaded Q of this resonator is ~750. For critical coupling for these rod spacings, the CPW line is shorted 3 mm into the first and last defect.

Figure 3:
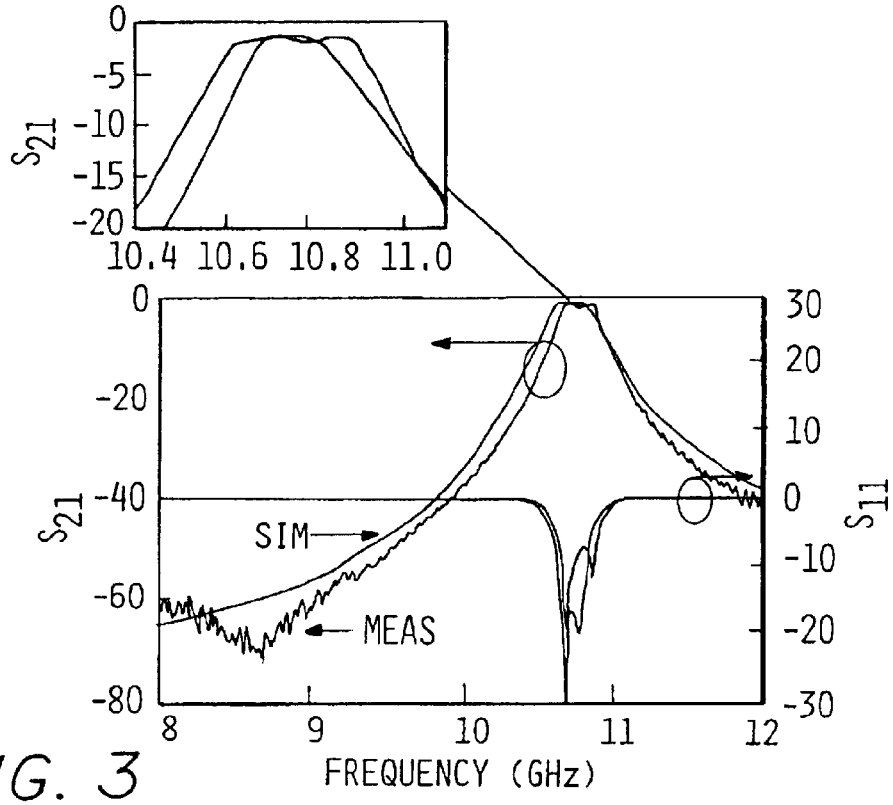
FIG. 3 is a graph for a 2-pole filter comparing FEM simulation with actual measurements.
Figure 4:
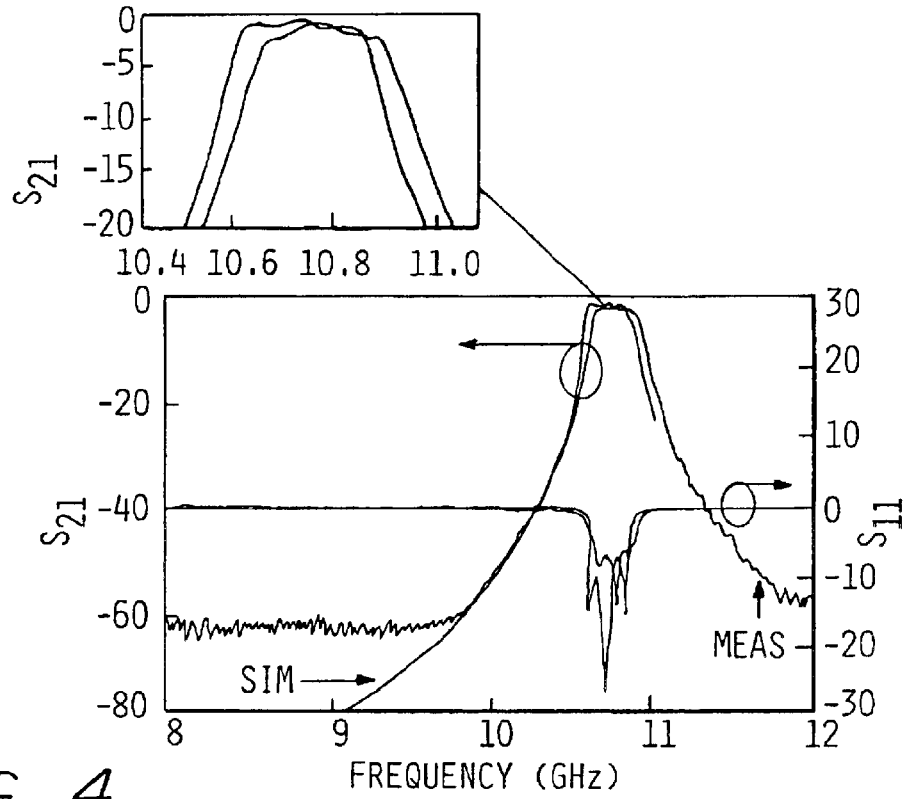
FIG. 4 is a graph for a 3-pole filter comparing FEM simulation with actual measurements.

These same parameters were used in cascaded stages to create multiple pole filters. A three pole and a six-pole filter were developed with the goal of an optimal insertion loss relative to a maximum out of bandwidth isolation. The results can be seen in the plots of FIGS. 3, 4, and 5. Also, these results can be numerically compared in the table below.

| FILTER | CENTER FREQUENCY (GHz) | INSERTION LOSS (dB) | BAND-WIDTH (GHz) | ISOLATION 7% OFF CENTER |
|---|---|---|---|---|
| 2-Pole Sim | 10.727 | −1.37 | 0.263 | −32 dB |
| 2-Pole Meas | 10.787 | −1.23 | 0.265 | −30 dB |
| 3-Pole Sim | 10.73 | −1.32 | 0.290 | −42 dB |
| 3-Pole Meas | 10.797 | −1.56 | 0.293 | −45 dB |
| 6-Pole Sim | 10.725 | −3.26 | 0.279 | >−100 dB |
| 6-Pole Meas | 10.8275 | −3.28 | 0.257 | −80 dB |

The measurements and simulation compare favorably. The resonant frequency agrees within 1% in all cases (0.5% in the two-pole filter, 0.7% for the three-pole filter, and 0.8% in the six-pole filter). The slight shift in frequency is due to the fact that the FEM model used cannot accurately model complete circles and must approximate circles as polygons. Therefore, the vias were simulated slightly different than what was measured. The bandwidth is nearly exact for the 2- and 3-pole filters (<1% difference) but is 23 MHZ less for the measured six-pole filter. The difference in bandwidth for the six-pole filter is the result of the hand placement of the feed lines relative to the lattice of vias. Due to the misalignment, the measured filter is not exactly critically coupled. The outside poles in the measured response are so weakly coupled that they do not factor in the pass band bandwidth. Also evident in the comparison is the increased ripple in the pass band of the measured filters. The ripple is also caused by weak external coupling to the filters. The out-of-band isolation was excellent, due to the fact that the substrate does not support substrate modes. For the six-pole filter, the transmission reached the noise floor 4.3% away from the center frequency. The out-of-band isolation is limited by the space wave coupling of the CPW lines, which can be eliminated by packaging the CPW lines, placing a reflective boundary or absorber between the ports, or by fabricating the CPW lines on opposite sides of the substrate. Note that the measured results were achieved without tuning any of the parameters.

Figure 5:
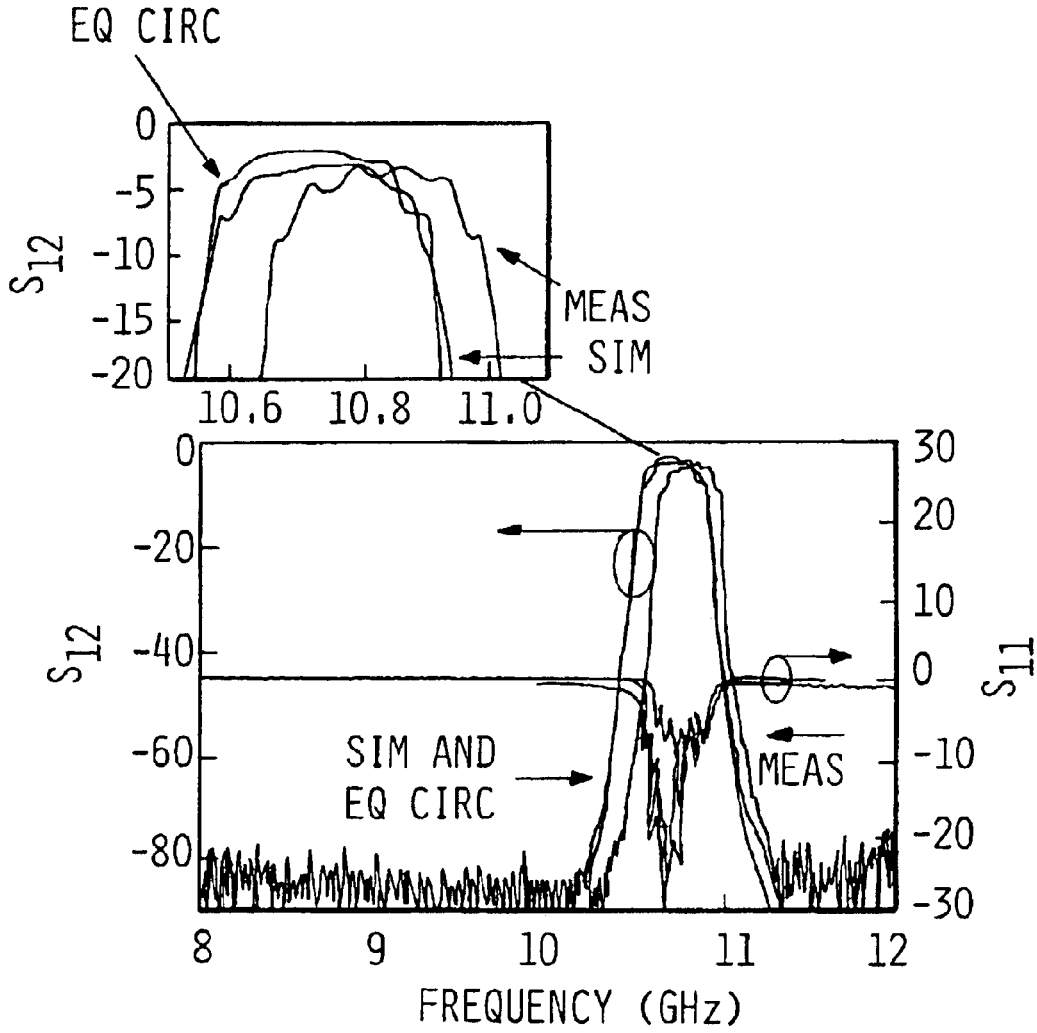
FIG. 5 is a graph for a six-pole filter comparing an optimized equivalent circuit, a full-wave simulation, and actual measurements.

An equivalent circuit was extracted using one- and two-pole simulations and the procedures explained above. The values for the equivalent shunt resonator are: C=53 pF, $L_{rea}$=4.13 pH and R=209 ohms. Note that the values are for the resonator after being transformed through the shorted CPW line transition. There are no unique solutions for these values, and the values relative to the transformers were found to be $L_{COUP}$=0.25 nH and n=1.9, respectively. The single resonator and the coupling inverter were then cascaded to form multipole filters. The results of the cascaded 6-pole filter are shown in FIG. 5 in comparison with the full-wave simulation and measured results. The correlation between the equivalent circuit and the measured and simulated values is quite similar. However, the insertion loss for the equivalent circuit is −2.3 dB. The theoretical optimum is 1 dB less than what is simulated and measured. This optimum value, however, does not account for losses in the feed lines and connectors, unlike the simulated and measured results. In addition, the difference is in part due to the measured and simulated filters not being exactly critically coupled. Through the use of the equivalent circuit, rapid adjustments to the filter may be made. Also, physical insight and the theoretical limits of the filter may be obtained.

In conclusion, a relatively simple, high-Q filter was measured, simulated, and analyzed with good agreement and without the need for tuning. High isolation was obtained since substrate noise is eliminated using the properties of the EBG substrate. A low insertion loss was obtained due to the low loss nature of the resonators. The performance is superior to what could be obtained in other planar architectures. The EBG/via aperture architecture makes these filters amenable to planar circuit integration. More advanced geometries and materials are expected to make these filters smaller with even better performance in future applications.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A planar filter comprising:

an electromagnetic bandgap substrate having two opposite sides, wherein the electromagnetic bandgap substrate is coated with metal on each of the two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity.

2. The filter of claim 1 wherein the inclusions further comprise dielectric rods.

3. The filter of claim 1 wherein the at least two resonant cavities create a multipole filter.

4. The filter of claim 1 wherein a shape, a size, and a period of the plurality of inclusions within the periodic lattice are selected to control a coupling field of adjacent ones of the at least two resonant cavities.

5. The filter of claim 1 wherein the at least one external line further comprises first and second external lines fabricated on opposite sides of the periodic lattice of the substrate wherein the first external line extends into a region associated with a first resonant cavity and the second external line extends into a region associated with a second resonant cavity.

6. The filter of claim 5 wherein the first external line extends through an input port and the second external line extends through an output port.

7. The filter of claim 1 wherein each line of the at least one external line comprises a CPW line.

8. The filter of claim 1 wherein a dimensional size of each inclusion of the plurality of inclusions is selected to obtain a desired coupling between adjacent ones of the at least two resonant cavities.

9. The filter of claim 8 wherein each inclusion of the plurality of inclusions is a rod.

10. The filter of claim 9 wherein the dimensional size is a radius of the rod.

11. The filter of claim 1 wherein a period of the periodic lattice is selected to obtain a desired coupling between adjacent ones of the at least two resonant cavities.

12. The filter of claim 1 wherein the defect in the periodic lattice comprises at least one missing inclusion.

13. The filter of claim 1 wherein each one of the at least two resonant cavities is separated from an adjacent one of the at least two resonant cavities by at least one inclusion.

14. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein sidewalls of the at least two resonant cavities define a high pass two-dimensional spatial filter with periodic short evanescent sections.

15. The filter of claim 14 wherein the evanescent sections create a rejection of the high pass two-dimensional spatial filter.

16. The filter of claim 15 further comprising:

means for predetermining the rejection of the high pass two-dimensional spatial filter as a function of a spacing between the inclusions forming the short evanescent sections.

17. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice, wherein the inclusions include metallic rods; and at least one external line extending through the lattice and projecting into a region associated with at least one resonant cavity.

18. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, the at least two resonant cavities creating a multipole filter, wherein a coupling between adjacent ones of the at least two resonant cavities is constant.

19. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein respective differences between two distinct peaks resulting from a coupling of two of the at least two resonant cavities and a central frequency peak of a single resonant cavity is a measure of a coupling coefficient.

20. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein a location of a first resonant cavity of the at least two resonant cavities in relation to an evanescent field from an adjacent resonant cavity of the at least two resonant cavities determines a coupling field of the defects.

21. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice;

at least one external line extending through the lattice and projecting into a region associated with at least one resonant cavity; and more than one inclusion in the periodic lattice separating adjacent ones of the at least two resonant cavities from each other to weaken a coupling field of respective ones of the at least two resonant cavities.

22. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein a coupling field between adjacent ones of the at least two resonant cavities is decreased by providing a resonant frequency deeper within a bandgap region and by increasing the separation between the adjacent ones.

23. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein a coupling field between adjacent ones of the at least two resonant cavities is decreased by providing a resonant frequency with sharper field attenuation in the surrounding lattice.

24. A planar filter comprising:

an electromagnetic band gap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein decreasing a dimensional size of each inclusion of the plurality of inclusions increases a coupling between adjacent ones of the at least two resonant cavities.

25. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein increasing a period of the periodic lattice increases a coupling field between adjacent ones of the at least two resonant cavities.

26. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice;

at least one external line extending through the lattice and projecting into a region associated with at least one resonant cavity; and an input port and an output port on opposite sides of the periodic lattice of the substrate.

27. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, each line of the at least one external line including a CPW line, wherein a length of the CPW line is selected to provide a minimum insertion loss.

28. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein a size of each inclusion of the plurality of inclusions is large relative to a period of the periodic lattice.

29. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein the at least two resonant cavities includes at least a first resonant cavity and a second resonant cavity coupled so that a transmission band maximum through the substrate results.

30. A planar filter comprising:

an electromagnetic bandgap substrate having two opposite sides;

a periodic lattice defined by a plurality of inclusions extending between the two opposite sides in a substantially uniform geometric pattern and at least two separate resonant cavities in proximity to one another, each of the at least two resonant cavities resulting from a defect in the periodic lattice; and at least one external line extending through the lattice and projecting into a region associated with at least one resonant cavity, wherein the at least two resonant cavities include at least a first resonant cavity and a second resonant cavity coupled to create passband characteristics through the substrate defining means for bandpass filtering.

* * * * *